US007284291B2

(12) United States Patent
Wang

(10) Patent No.: US 7,284,291 B2
(45) Date of Patent: Oct. 23, 2007

(54) INFLATABLE PRODUCT WITH AN INTEGRATED PUMP

(76) Inventor: Cheng-Chung Wang, 12F, No. 440, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 11/385,094

(22) Filed: Mar. 21, 2006

(65) Prior Publication Data

US 2006/0213013 A1 Sep. 28, 2006

(30) Foreign Application Priority Data

Mar. 25, 2005 (CN) ..... 2005 2 0056145

(51) Int. Cl.
*A47C 27/08* (2006.01)

(52) U.S. Cl. ..... 5/713; 5/711

(58) Field of Classification Search ..... 7/706, 7/709, 711–713
See application file for complete search history.

(56) References Cited

U.S. PATENT DOCUMENTS

| | | | | |
|---|---|---|---|---|
| 6,543,073 | B2 * | 4/2003 | Wu | 5/713 |
| 6,836,914 | B1 * | 1/2005 | Tsai | 5/713 |
| 6,955,527 | B2 * | 10/2005 | Yen | 417/360 |
| 7,039,972 | B2 * | 5/2006 | Chaffee | 5/706 |
| 7,120,955 | B2 * | 10/2006 | Wang | 5/706 |
| 7,127,762 | B1 * | 10/2006 | Lau | 5/713 |
| 7,152,265 | B2 * | 12/2006 | Chung | 5/710 |

* cited by examiner

*Primary Examiner*—Michael Trettel
(74) *Attorney, Agent, or Firm*—William E. Pelton, Esq.; Cooper & Dunham LLP

(57) ABSTRACT

An inflatable product includes an inflatable body with a recess. A pump matching the recess is installed in the recess. Whereby, the inflatable body and pump are integrated together, and it is very convenient to use and carry. Furthermore, the pump is concealed in the inflatable product, giving the inflatable product an attractive appearance.

7 Claims, 13 Drawing Sheets

INFLATABLE PRODUCT WITH AN INTEGRATED PUMP

BACKGROUND OF THE INVENTION

1. Field of the Invention

The present invention relates to an inflatable product, and more particularly to an inflatable product with an integrated pump.

2. Description of Related Art

Inflatable products such as balloons, buoys, and air mattresses need to be inflated for use and deflated for storage. A separate external pump is generally used for inflating/deflating. Thus, it is inconvenient to use and store an inflatable product and a pump.

Therefore, the invention provides an inflatable product with an integrated pump to mitigate or obviate the aforementioned problems.

SUMMARY OF THE INVENTION

The main objective of the present invention is to provide an inflatable product with an integrated pump.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1A to 1D, in a first embodiment of an inflatable product in according with the present invention, the inflatable product is an inflatable bed with an inflatable body (1) having a top surface, a bottom surface and four side surfaces between the top surface and bottom surface. A definition of the inflatable body (1) herein is a body that is substantially airtight and expands when filled with air or gas. A recess (12) is defined at a first side surface (11). A pump (2) is received in the recess (12) and integrally combined with the inflatable body (1). The recess (12) and the pump (2) are cylindrical, and the recess (12) is slightly larger than the pump (2).

Figure 1A:
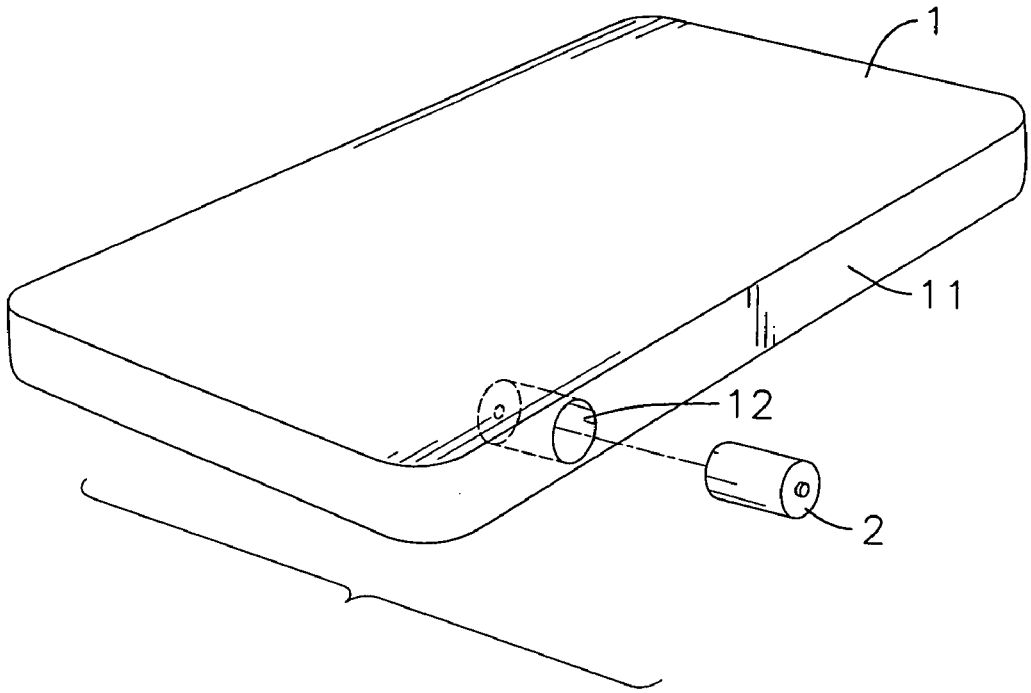
FIG. 1A is an exploded perspective view of a first embodiment of an inflatable product in accordance present invention.
Figure 1B:
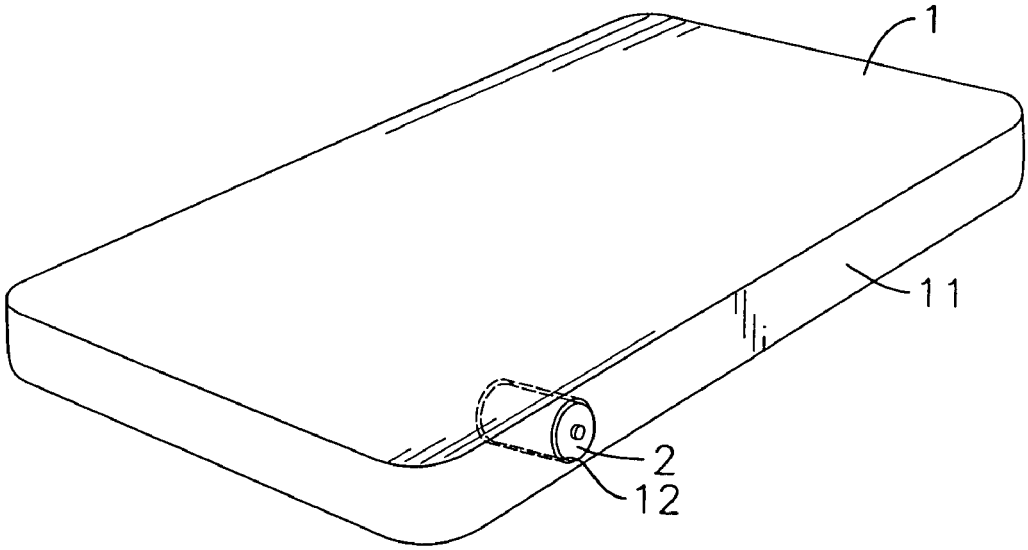
FIG. 1B is a perspective view of the inflatable product in FIG. 1A.
Figure 1C:
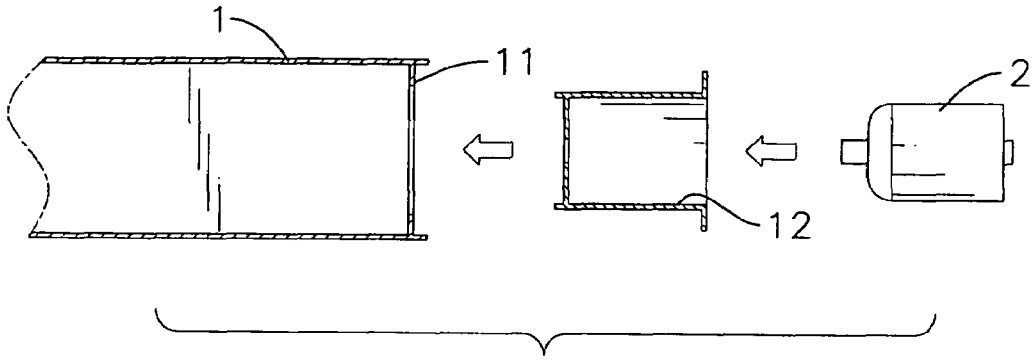
FIG. 1C is an exploded side plan view in partial cross section of the inflatable product in FIG. 1A.
Figure 1D:
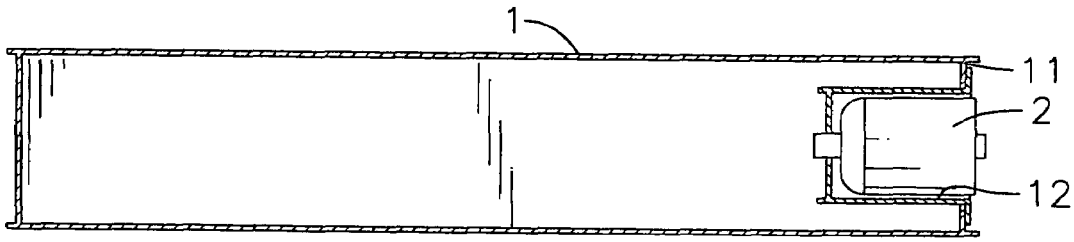
FIG. 1D is a side plan view in partial cross section of the inflatable product in FIG. 1C.
Figure 2:
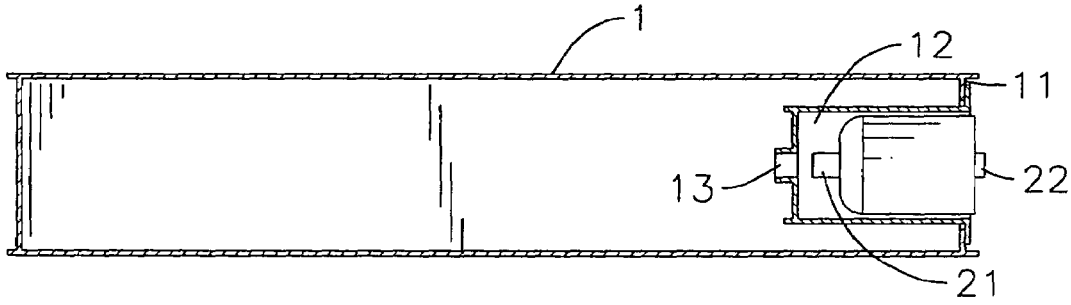
FIG. 2 is a side plan view in partial cross section of a second embodiment of an inflatable product in accordance with the present invention.
Figure 3A:
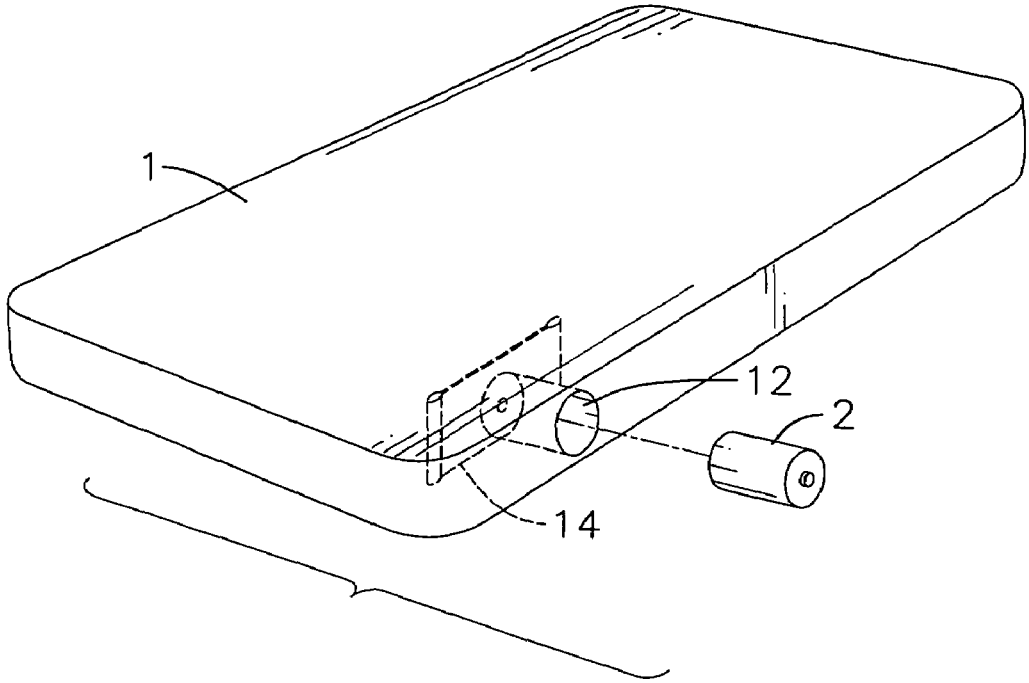
FIG. 3A is an exploded perspective view of a third embodiment of an inflatable product in accordance with the present invention.
Figure 3B:
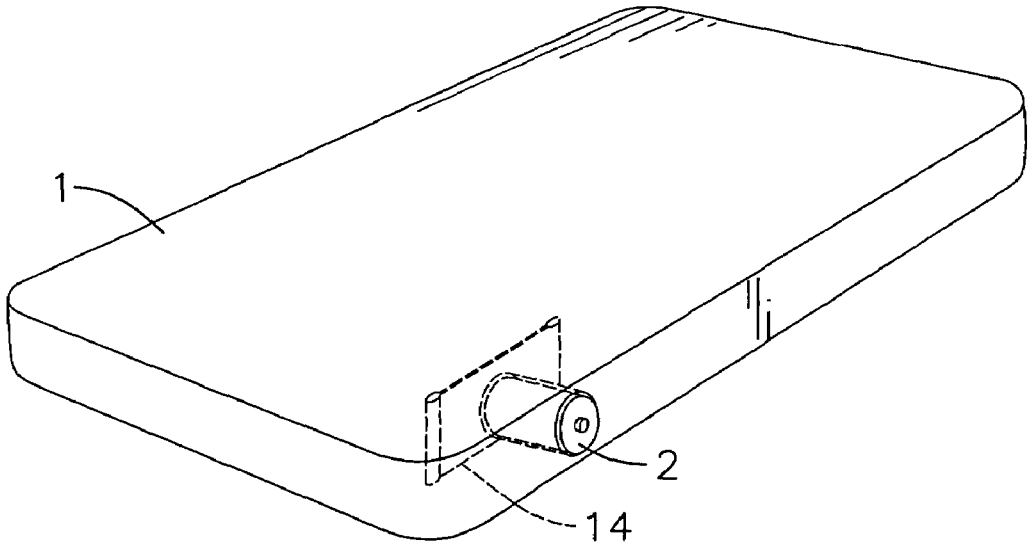
FIG. 3B is a perspective view of the inflatable product in FIG. 3A.
Figure 3C:
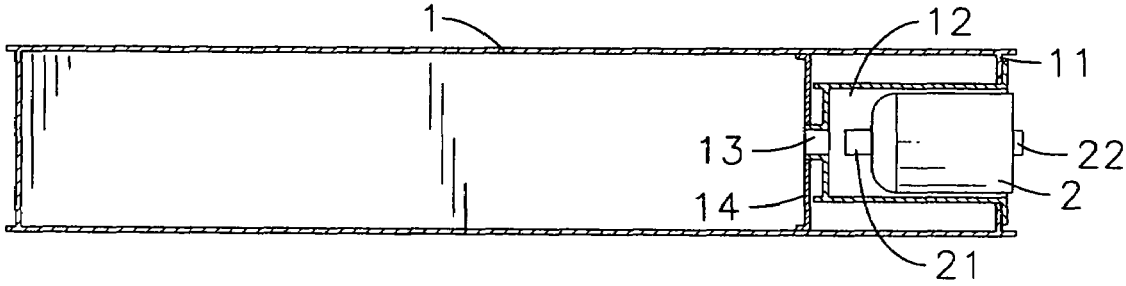
FIG. 3C is a side plan view in partial cross section of the inflatable product in FIG. 3A.

With reference to FIGS. 3A to 3C, in a third embodiment, a reinforcing panel (14) is fixed inside the inflatable body (1) between the top surface and bottom surface near or at the recess (12) and around the inlet port (13). The reinforcing panel (14) is to prevent the surface adjacent the inlet port (13) from bulging during inflating. This bulging may cause the pump (2) to be partly pushed out of the recess (12).

Figure 4A:
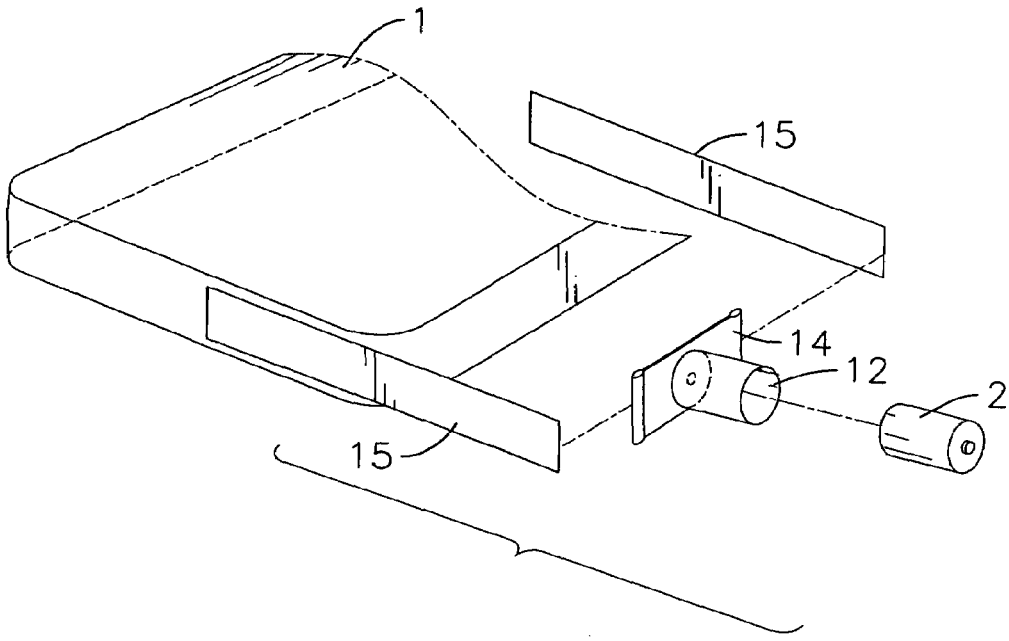
FIG. 4A is an exploded perspective view of a fourth embodiment of an inflatable product in accordance with the present invention.
Figure 4B:
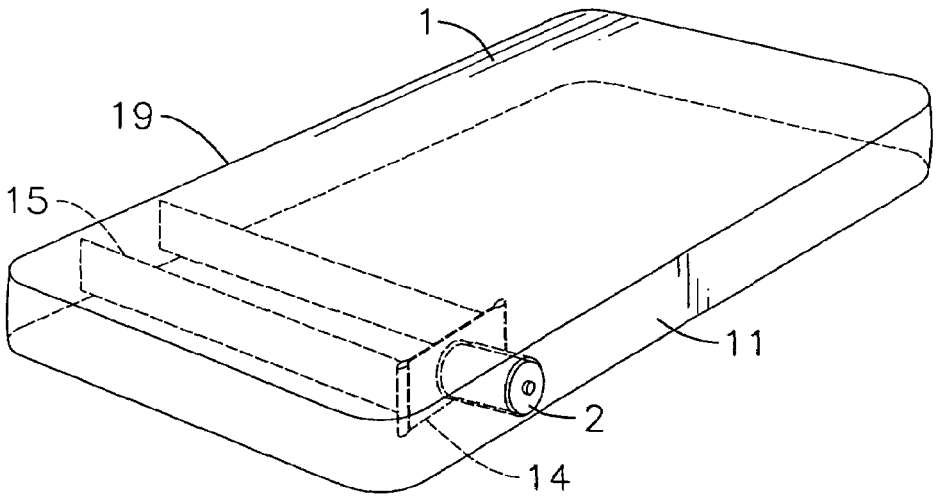
FIG. 4B is a perspective view of the inflatable product in FIG. 4A.
Figure 4C:
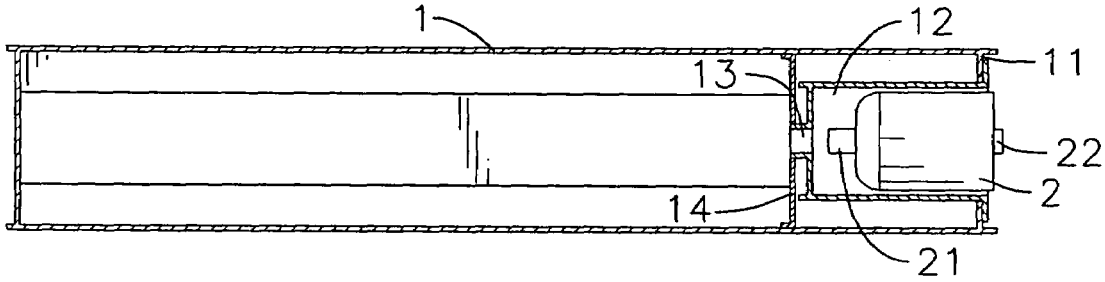
FIG. 4C is a side plan view in partial cross section of the inflatable product in FIG. 4A.

With reference to FIGS. 4A to 4C, in a fourth embodiment, two reinforcing strips (15) are formed between the reinforcing panel (14) and a second side surface (19) opposite the first side surface (11). The reinforcing strips (15) are substantially perpendicular to the reinforcing panel (14) and the first and second side surfaces (11, 19) to further prevent bulging.

Figure 5A:
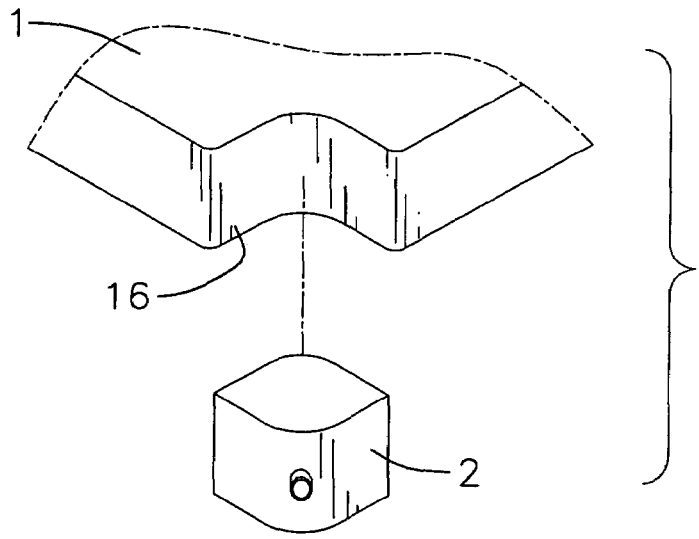
FIG. 5A is an exploded perspective view of a fifth embodiment of an inflatable product in accordance with the present invention.
Figure 5B:
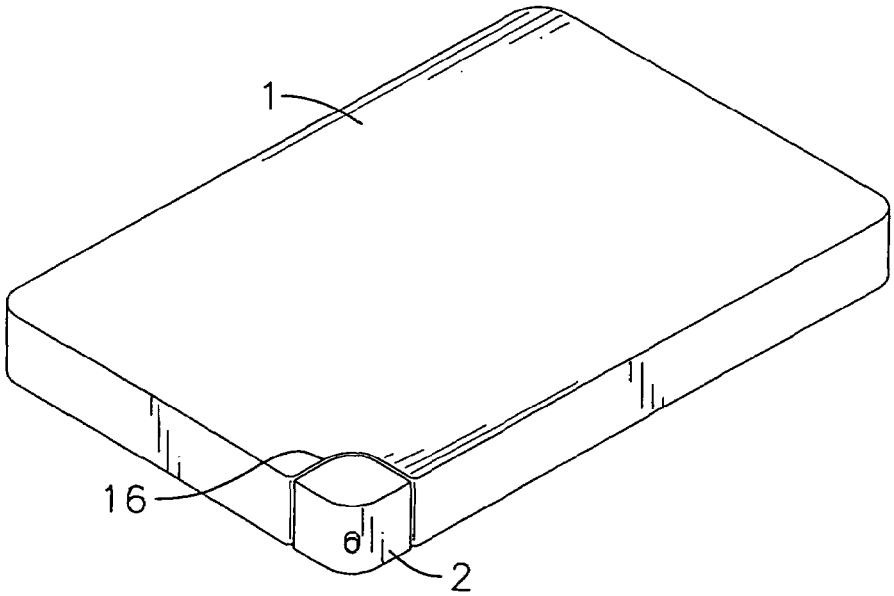
FIG. 5B is a perspective view of the inflatable production in FIG. 5A.
Figure 5C:
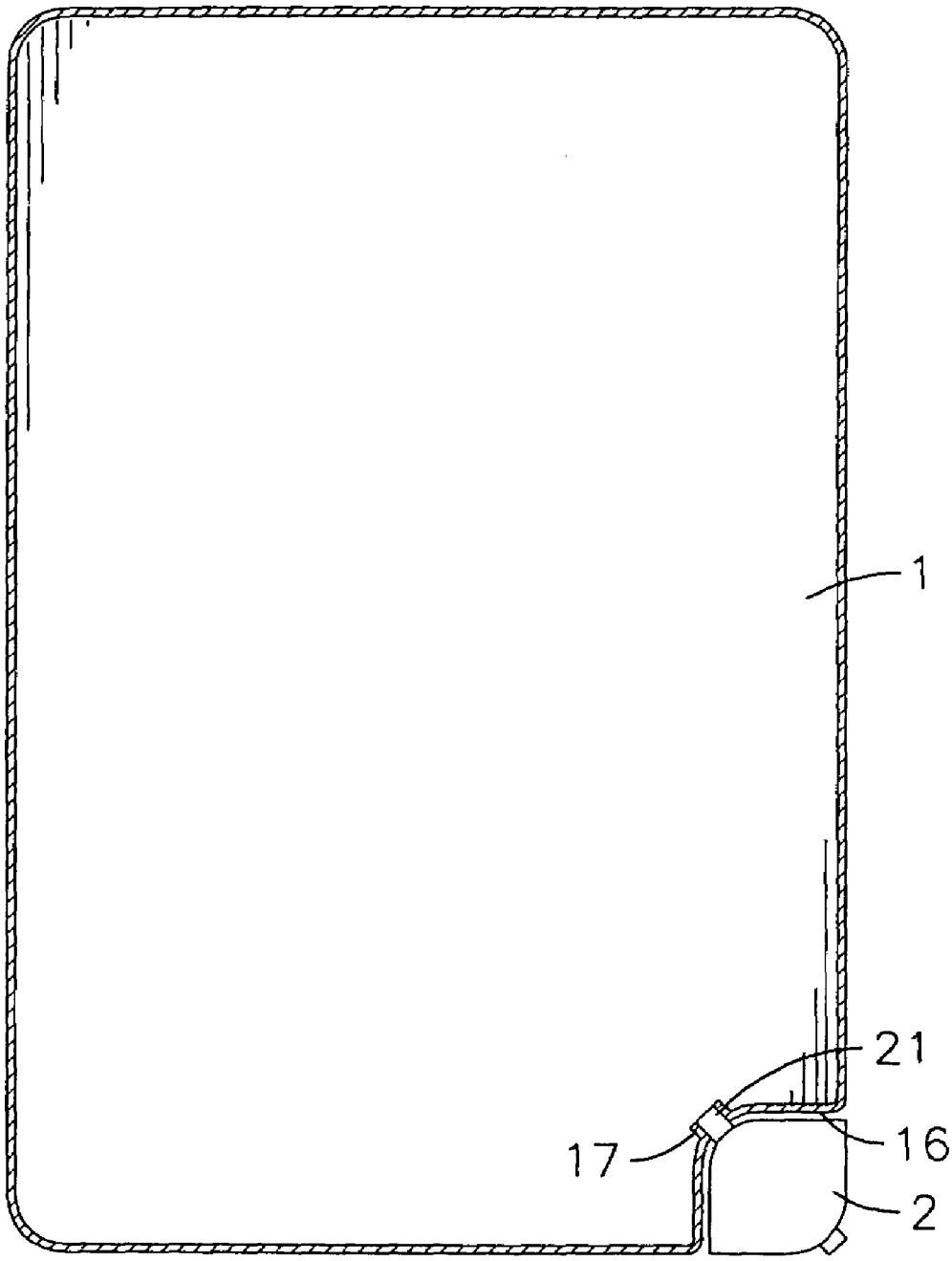
FIG. 5C is a top view in partial cross section of the inflatable product in FIG. 5A.

With reference to FIGS. 5A to 5C, in a fifth embodiment, the inflatable body (1) has a recess (16) completely defined through a corner thereof and an inlet port (17) formed in the recess (16). A pump (2) with a shape matching the recess (16) is installed in the recess (16). The pump (2) has an inflating nozzle (21) facing the inlet port (17).

Figure 6A:
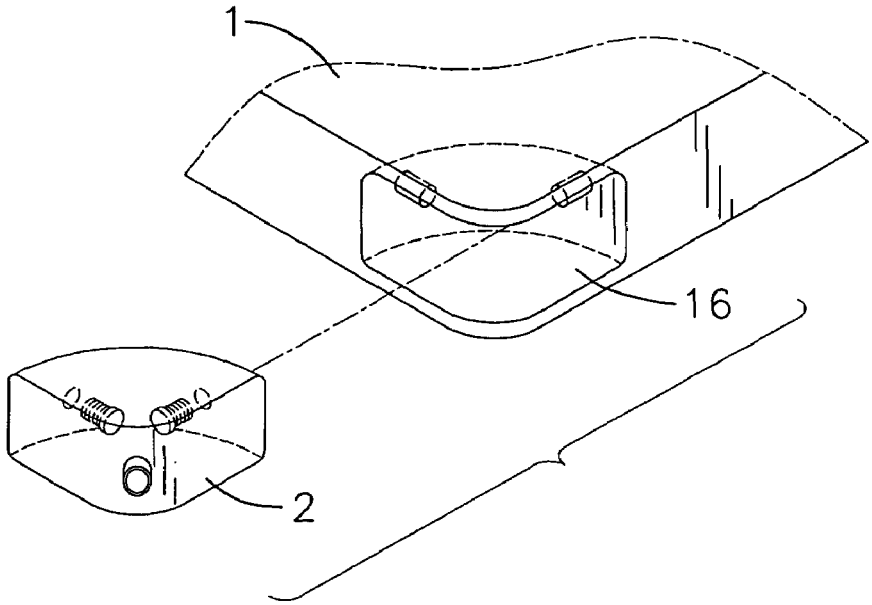
FIG. 6A is an exploded perspective view of a sixth embodiment of an inflatable product in accordance with the present invention.
Figure 6B:
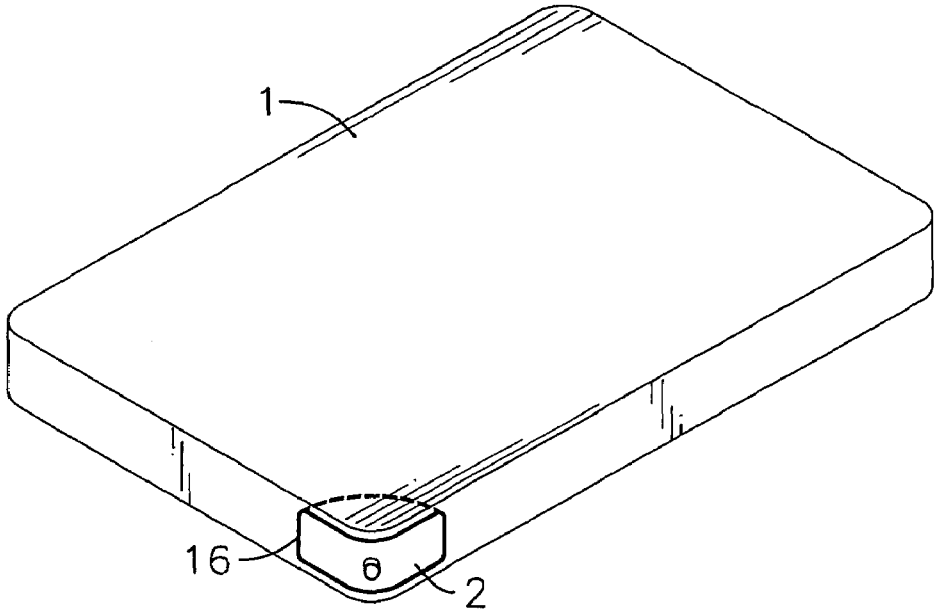
FIG. 6B is a perspective view of the inflatable product in FIG. 6A.

With reference to FIGS. 6A and 6B, in a sixth embodiment, the inflatable body (1) has a recess (16). The recess (16) is solid and is mounted at a corner of the inflatable. The pump (2) is installed in the recess (16) by screws mounted through a casing of the pump and the recess (16).

Figure 7:
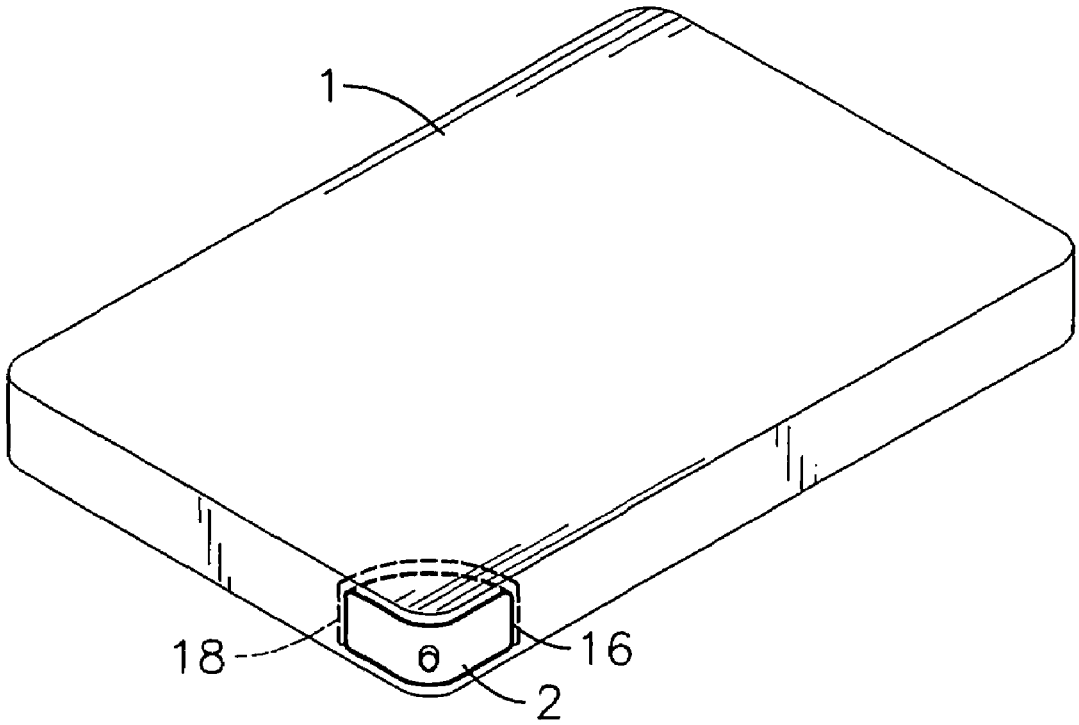
FIG. 7 is a perspective view of a seventh embodiment of an inflatable product in accordance with the present invention.

With reference to FIG. 7, in a seventh embodiment, the inflatable body (1) has a recess (16) partly defined at the corner thereof and a reinforcing panel (18) fixed inside the inflatable body (1) around the recess (16). The pump (2) is installed in the recess (16).

Figure 8A:
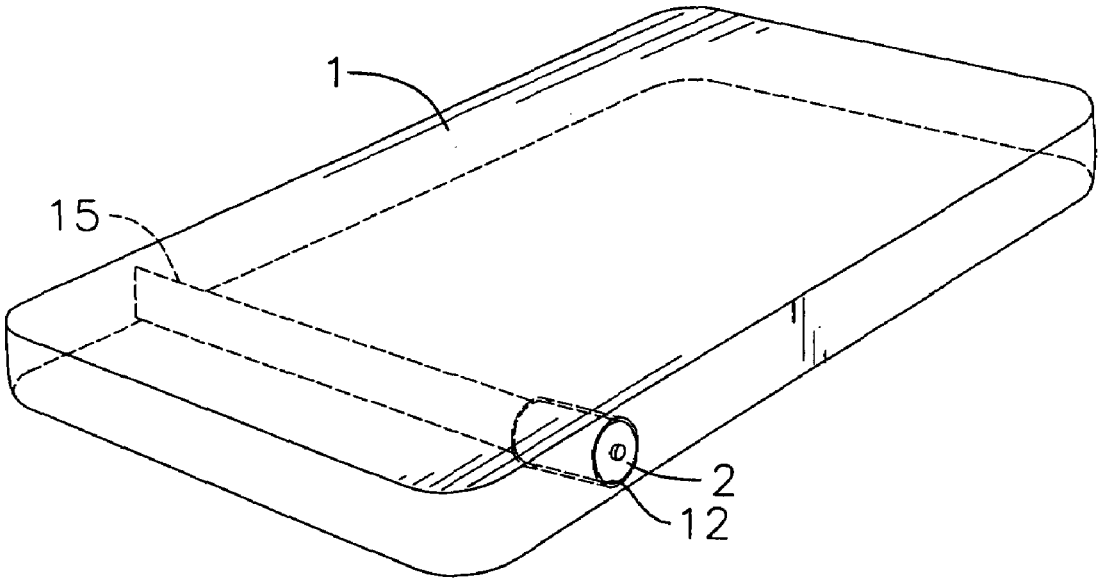
FIG. 8A is a perspective view of a eighth embodiment of an inflatable product in accordance present invention.
Figure 8B:
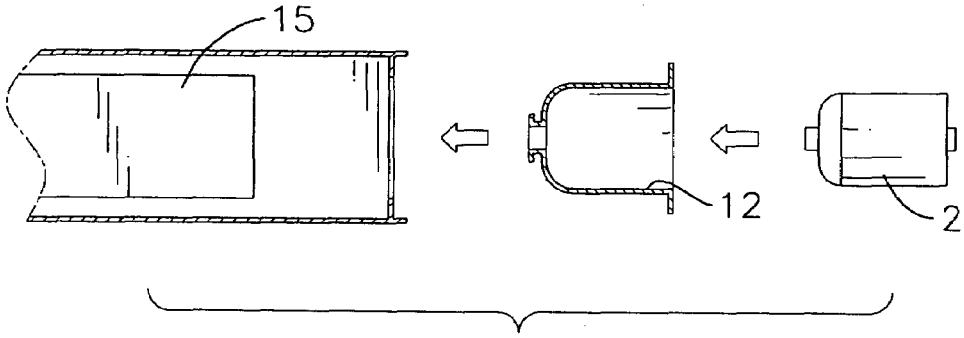
FIG. 8B is an exploded side plan view in partial cross section of the inflatable product in FIG. 8A.
Figure 8C:
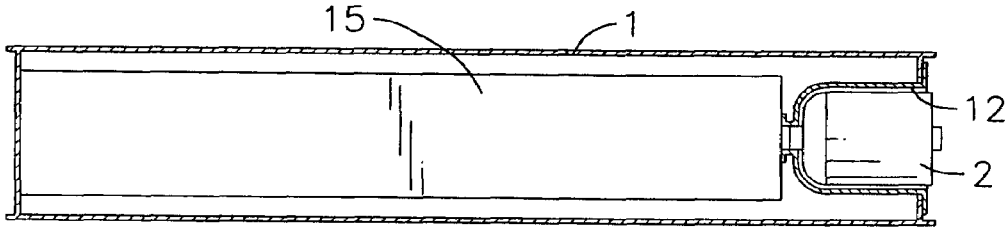
FIG. 8C is a side plan view in partial cross section of the inflatable product in FIG. 8B.

With reference to FIGS. 8A to 8C, an eighth embodiment of the inflatable bed (1) in accordance with the present invention has a recess (12) and a reinforcing strip (15). The recess (12) is mounted in the inflatable body (1) and has an inlet port. The reinforcing strip (15) has two ends. One end is connected to an inner surface of the inflatable body (1) and the other end is connected to the inlet port of the recess (12). The pump (2) is mounted in the recess (12) and has an inflating nozzle corresponding to in the inlet port.

Thus, according to the present invention, the inflatable bed (1) and pump (2) are integrally combined together, making it very convenient to use and carry them. Furthermore, the pump (2) is concealed in the inflatable bed (1), giving the inflatable bed (1) an attractive appearance.

Although an inflatable bed is described above, those skilled in the art will know that the present invention is applicable for other inflatable products.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inflatable product comprising:

an inflatable body having an inner surface, a top surface, a bottom surface, four side surfaces between the top surface and bottom surface, and four corners, each between two adjacent side surfaces, and the inflatable body further having a recess having an inlet port formed on the recess; and a reinforcing panel connected to the recess and extending between the inner surface and the recess; and a pump installed in the recess and having an inflating nozzle facing in the inlet port.

2. The inflatable product as claimed in claim 1, wherein the inflatable body has at least one reinforcing strip extending between the reinforcing panel and the inner surface of the inflatable body.

3. An inflatable product comprising an inflatable body having a top surface, a bottom surface, four side surfaces between the top surface and bottom surface, and four corners, each between two adjacent side surfaces, and the inflatable body further having a recess completely defined through one of the corners; and a pump matching and installed in the recess.

4. The inflatable product as claimed in claim 3, wherein an inlet port is formed in the recess, and the pump has an inflating nozzle facing the inlet port.

5. The inflatable product as claimed in claim 4, wherein a reinforcing panel is connected to the recess.

6. An inflatable product comprising an inflatable body having a top surface, a bottom surface, four side surfaces between the top surface and bottom surface, and four corners, each between two adjacent side surfaces, and the inflatable body further having a recess partly defined at one of the corners; and a pump matching and installed in the recess.

7. An inflatable product comprising an inflatable body having an inner surface; and a recess mounted in the inflatable body and having an inlet port;

a pump installed in the recess and having an inflating nozzle corresponding to the inlet port; and a reinforcing strip extending between the inner surface of the inflatable body and the recess.

* * * * *